US005382021A

United States Patent [19]

Tatesaka et al.

[11] Patent Number: 5,382,021

[45] Date of Patent: Jan. 17, 1995

[54] HORSE RACING GAME HAVING ROTATING ARM AND TETHERED MEMBERS

[75] Inventors: Hiroyuki Tatesaka; Takanao Moritsu, both of Setagaya, Japan

[73] Assignee: Sigma, Incorporated, Tokyo, Japan

[21] Appl. No.: 252,688

[22] Filed: Jun. 2, 1994

[30] Foreign Application Priority Data

Jun. 7, 1993 [JP] Japan ..... 5-135908
Jun. 7, 1993 [JP] Japan ..... 5-135912

[51] Int. Cl.[6] ..... A63F 9/14

[52] U.S. Cl. ..... 273/86 R; 273/86 H; 104/61

[58] Field of Search ..... 273/86 R, 86 B, 86 F, 273/86 G, 86 H; 104/60, 61, 63; 446/444, 446

[56] References Cited

U.S. PATENT DOCUMENTS

| | | | |
|---|---|---|---|
| 2,486,273 | 10/1949 | Gibson | 273/86 B |
| 2,555,785 | 6/1951 | Cook | 273/86 B |
| 3,326,555 | 6/1967 | Warren | 273/86 H |
| 3,441,277 | 4/1969 | Winn | 273/86 F |

*Primary Examiner*—Vincent Millin
*Assistant Examiner*—Willam M. Pierce
*Attorney, Agent, or Firm*—Hickman & Beyer

[57] ABSTRACT

A plurality of carriers are towed by a traction car moving along a guide portion provided under a travel road surface plate through flexible pulling members. Mobile models on the travel road surface plate are attracted to the towed carriers by magnets. Hence, the mobile models on the travel road surface plate travel in accordance with the movement of the traction car. Furthermore, when a plurality of winch units provided to the traction car are separately operated to take up and rewind the pulling members, the plurality of mobile models travel at different speeds.

13 Claims, 8 Drawing Sheets

HORSE RACING GAME HAVING ROTATING ARM AND TETHERED MEMBERS

BACKGROUND OF THE INVENTION

1. Field of the Invention

The present invention relates to a racing game apparatus in which a plurality of mobile models travel on a predetermined travel road 2. Related Background Art A racing game apparatus in which a plurality of mobile models (horses, vehicles, and the like) are caused to travel on an annular travel road surface to compete for a faster arrival is popular. An example of a racing game apparatus of this type includes a Derby game, a car race, a boat race, and the like.

Conventionally, as a technique of this field, one disclosed in Japanese Patent Publication No. 52-38781 is known.

However, in the conventional racing game apparatus, since the respective mobile models 112*a* to 112*e* travel side by side on predetermined courses in accordance with the movement of the movable frames 121*a* to 121*e*, the racing game lacks reality and is not exciting when compared to an actual Derby race in which respective racing horses compete in disorder.

Especially, at the corners, since a mobile model on an outer course moves faster than a mobile model on an inner course, the race lacks reality.

An apparatus of a type wherein mobile models are remote-controlled by utilizing infrared rays so that they compete in disorder conventionally exists. However, since receivers and drivers must be incorporated in the mobile models, size reduction of the mobile model is difficult. Therefore, it is difficult to decrease the approach distance between the mobile models, and thus the race lacks reality.

As described above, in the conventional racing game apparatus, the pivot table 118 provided on the travel board 116 which reciprocally moves is rotated as the travel board 116 changes its direction, thereby causing the mobile models 112*a* to 112*e* to circulate on an elliptic track. Since an elliptic movement is achieved by combining the linear and rotary movements in this manner, a timing for shifting from the linear movement to the rotary movement is difficult to determine, and a mechanism for achieving smooth shift is complicated. To place the pivot table 118 on the travel board 116, the travel board 116 must be made strong, leading to a large size of the overall apparatus.

SUMMARY OF THE INVENTION

It is an object of the present invention to solve the above problems, thereby providing a racing game apparatus capable of course change at corners.

It is another object of the present invention to solve the above problems, thereby providing a racing game apparatus having a simple structure.

In order to achieve the above objects, a racing game apparatus according to one aspect of the present invention comprises a permeable travel road surface plate, a guide portion provided under the travel road surface plate along a travel road, a traction car which moves along the guide portion under the travel road surface plate, a plurality of carriers which are towed by the traction car and attract the mobile models on the travel road surface plate by magnets, and a plurality of flexible pulling members for connecting the traction car with the plurality of carriers, wherein the traction car is provided with a plurality of winch units for taking up and rewinding the pulling members.

According to the racing game apparatus above, the plurality of carriers are towed by the traction car moving along the guide portion provided under the travel road surface plate through the flexible pulling members. The mobile models on the travel road surface plate are attracted to the towed carriers by the magnets. Hence, the mobile models on the travel road surface plate travel in accordance with the movement of the traction car. Furthermore, when the plurality of winch units provided to the traction car are separately operated to take up and rewind the pulling members, the plurality of mobile models travel at different speeds.

Since the traction car and the carriers are towed through the flexible pulling members, the respective carriers can freely move in a direction perpendicular to the travel direction. Thus, although the mobile models travel parallel to each other on the respective courses at straight portions of the travel road, at curved (corner) portions (and the straight portions before the curved portions when the pulling members are sufficiently long) of the travel road, the mobile models traveling on outer courses shift to the inner course, so that many mobile models travel on the inner course.

In order to solve the above problems, a racing game apparatus according to the other aspect of the present invention comprises a travel car provided under a travel road surface and self-traveling along a circulating track while attracting a plurality of mobile models the travel road surface, a rotary base arranged at substantially a center of the circulating track and having a rotary shaft perpendicular to a plane including the circulating track, a cable supporter, having one end fixed to the rotary shaft and the other end fixed to the travel car, and flexible only along the plane including the rotary shaft so as to follow the travel car in a straight state while rotating around the rotary shaft as the center, and power supply cables, covered with the cable supporter, for transmitting power, supplied to the rotary base, from the rotary base to the travel car.

According to the racing game apparatus above, power supplied to the rotary base is transmitted through the power supply cables extending in the cable supporter and is supplied to the travel car. Upon reception of the power, the travel car self-travels on a desired circulating track as it attracts a plurality of mobile models on the travel road surface. The cable supporter fixed to the travel car and the rotary base follows the travel car in a straight state while rotating around the rotary shaft of the rotary base as the center.

Even when the distance between the travel car and the rotary base changes upon travel along the elliptic track, since the cable supporter is flexibly bent along the plane including the rotary shaft of the rotary base, a change in distance between the travel car and the rotary base is absorbed, so that smooth travel along the elliptic track is enabled.

Furthermore, since the power supply cables extend through the interior of the cable supporter, they will not be entangled with each other even if the distance between the travel cars changes.

DESCRIPTION OF THE PREFERRED EMBODIMENT

Figure 1:
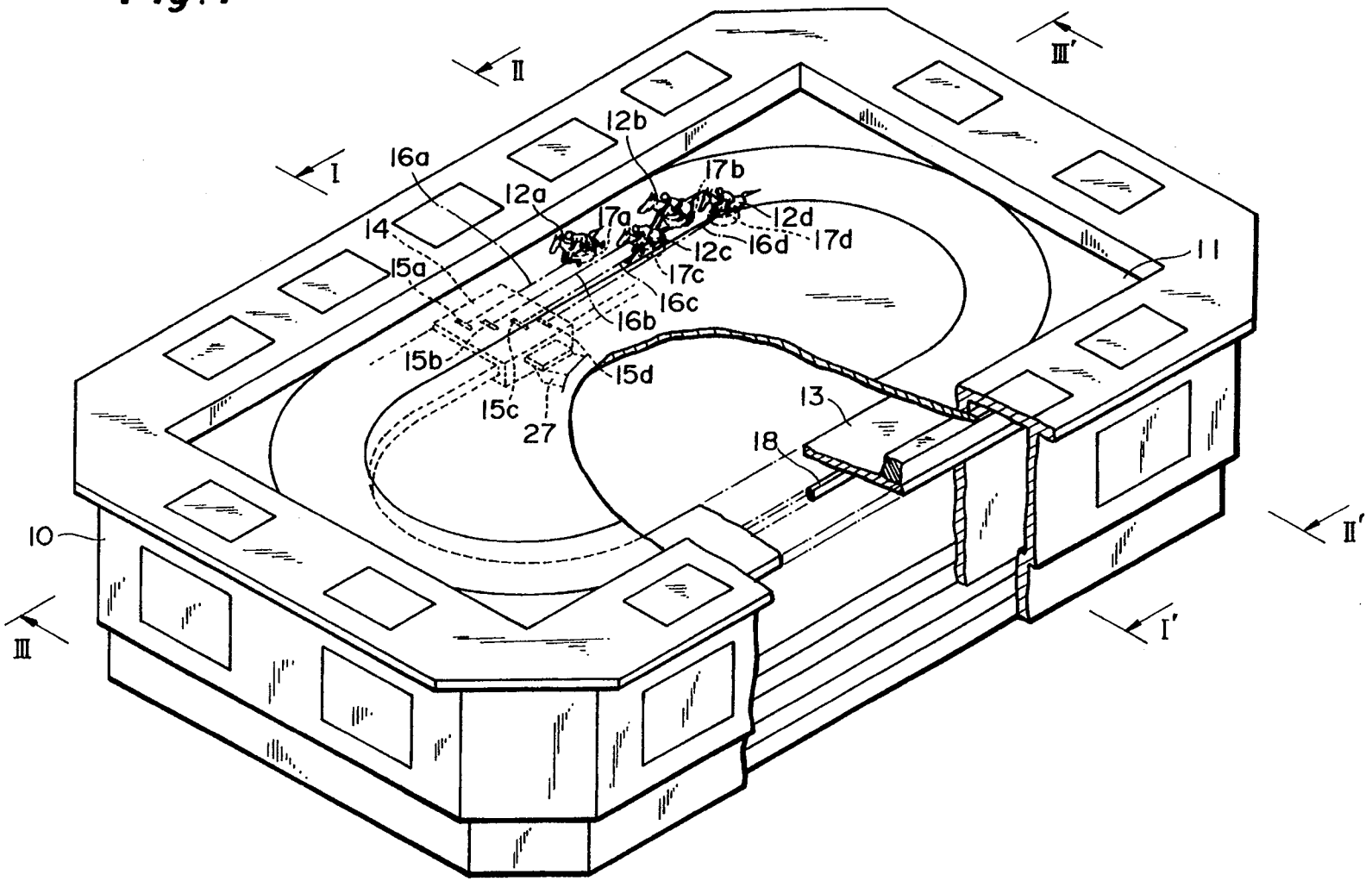
FIG. 1 is a perspective view showing the outer appearance of a racing game apparatus according to an embodiment of the present invention.

An embodiment of the present invention will be described with reference to the accompanying drawings. FIG. 1 is a perspective view showing the outer appearance of a racing game apparatus according to this embodiment. In this apparatus, a green travel road surface non-magnetic plate 11 having a field course drawn thereon is horizontally extended on the upper surface of a cabinet 10 obtained by obliquely cutting the four corners of a rectangular parallelepipe. Racing model bodies 12*a* to 12*e* resembling racing horses are placed on the travel road surface plate 11. A travel guide plate 13 having an opening inside the field course is horizontally extended in the cabinet 10, and a traction car 14 is placed to sandwich the travel guide plate 13. A plurality of traction winches 15*a* to 15*d* are provided on the upper surface of the traction car 14, and traction ropes 16*a* to 16*d* extend from the traction winches 15*a* to 15*d*. The traction ropes 16*a* to 16*d* are guided at the rear end of the traction car 14 so as to direct the traction ropes toward slidable shoes 17*a* to 17*d*. Therefore, the traction ropes 16*a* to 16*d* does not be rolled up by the other traction winches 15*a* to 15*d*. Slidable shoes 17*a* to 17*d* fitted with magnets are mounted on the distal ends of the traction ropes 16*a* to 16*d*, respectively, to attract the racing model bodies 12*a* to 12*d* having magnets fitted in their lower portions through the travel road surface plate 11. Magnet and ferromagnetic body may be used instead of the magnets.

The traction car 14 circulates on a guide rail 18 formed on the lower surface of the travel guide plate 13 along the field course, and the slidable shoes 17*a* to 17*d* towed by the traction car 14 also circulate in the same manner. Hence, the racing model bodies 12*a* to 12*d* attracted by the slidable shoes 17*a* to 17*d* also circulate in the same manner. From above the travel road surface plate 11, it looks as if the racing model bodies 12*a* to 12*d* were racing in the field course.

The structures of the traction car 14 and the slidable shoes 17*a* to 17*d* will be described with reference to FIGS. 2 and 3.

Figure 2:
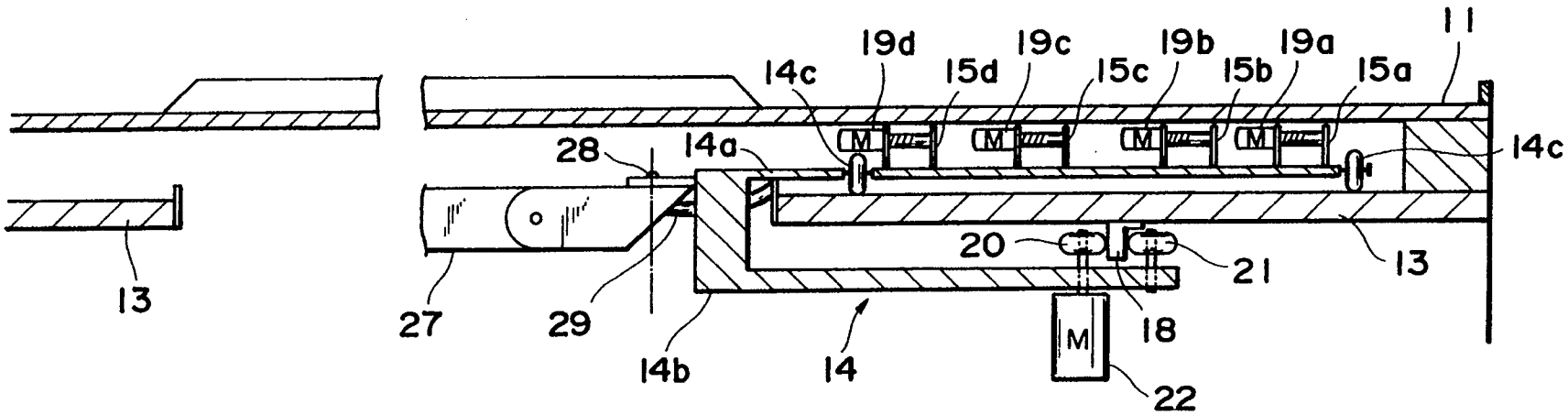
FIG. 2 is a sectional view showing the structure of a traction car and taken along a plane perpendicular to the travel direction.

FIG. 2 is a sectional view (I—I′ sectional view of FIG. 1) showing the structure of the traction car 14 and taken along a plane perpendicular to the travel direction. Referring to FIG. 2, the traction car 14 has a approximately U-shape and is placed to sandwich the travel guide plate 13. Wheels are provided to an upper surface plate 14*a* of the traction car 14 so that they can move on the travel guide plate 13. The traction winches 15*a* to 15*d* are preferably equidistantly provided on the upper surface plate 14*a* to tow the slidable shoes 17*a* to 17*d* made of non-magnetic material (See FIG. 1). Drive motors 19*a* to 19*d* such as stepping motor for taking up and rewinding the traction ropes 16*a* to 16*d* are provided to the traction winches 15*a* to 15*d*, respectively. A travel drive roller 20, a guide roller 21, and a travel drive motor 22 for driving the travel drive roller 20 are provided to a lower surface plate 14*b* of the traction car 14, and the travel drive roller 20 and the guide roller 21 sandwich the guide rail 18. The travel drive motor 22 receives a desired power from a power supply (not shown) to rotate the travel drive roller 20. DC motor, AC motor, and stepping motor can be used for the travel drive motor 22. Upon rotation of the travel drive roller 20, the traction car 14 travels along the guide rail 18 at a predetermined speed.

Figure 3:
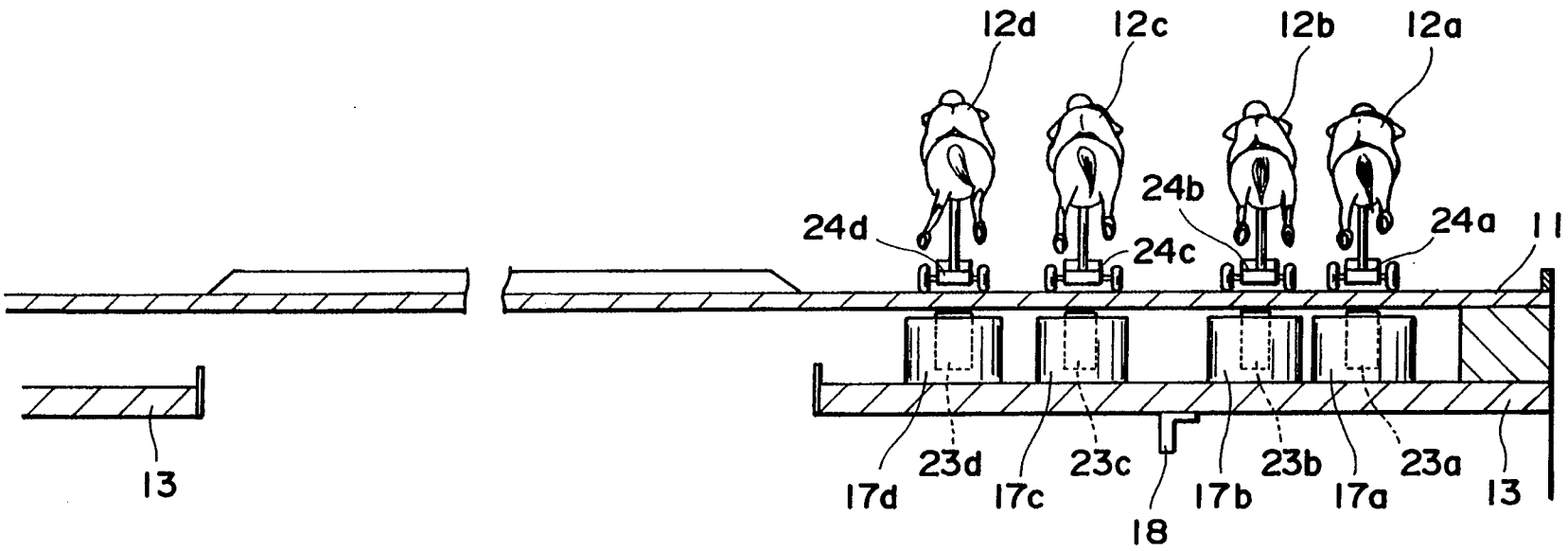
FIG. 3 is a sectional view showing the structures of slidable shoes and taken along a plane perpendicular to the travel direction.

FIG. 3 is a sectional view (II—II′ sectional view of FIG. 1) showing the structures of the slidable shoes 17*a* to 17*d* and taken along a plane perpendicular to the travel direction. Referring to FIG. 3, magnets 23*a* to 23*d* are fitted in the central portions of the slidable shoes 17*a* to 17*d* from above in such a manner that N-pole of the magnets are directed upwardly, for example. Magnets are fitted also in cars 24*a* to 24*d* of the racing model bodies 12*a*, 12*b*, . . . on the travel road surface plate 11 in such a manner that S-pole of the magnets are directed downwardly, thus the slidable shoes 17*a* to 17*d* and the cars 24*a* to 24*d* attract each other. Since wheels are provided to the cars 24*a* to 24*d* of the racing model bodies 12*a*, 12*b*, . . . , the racing model bodies 12*a*, 12*b*, . . . can travel in accordance with the movement of the slidable shoes 17*a* to 17*d*. Further, each center of the magnets are located before the center of gravitation of the cars. A plurality of magnets may be arranged in a line along the forwarding direction of the cars.

Figure 4:
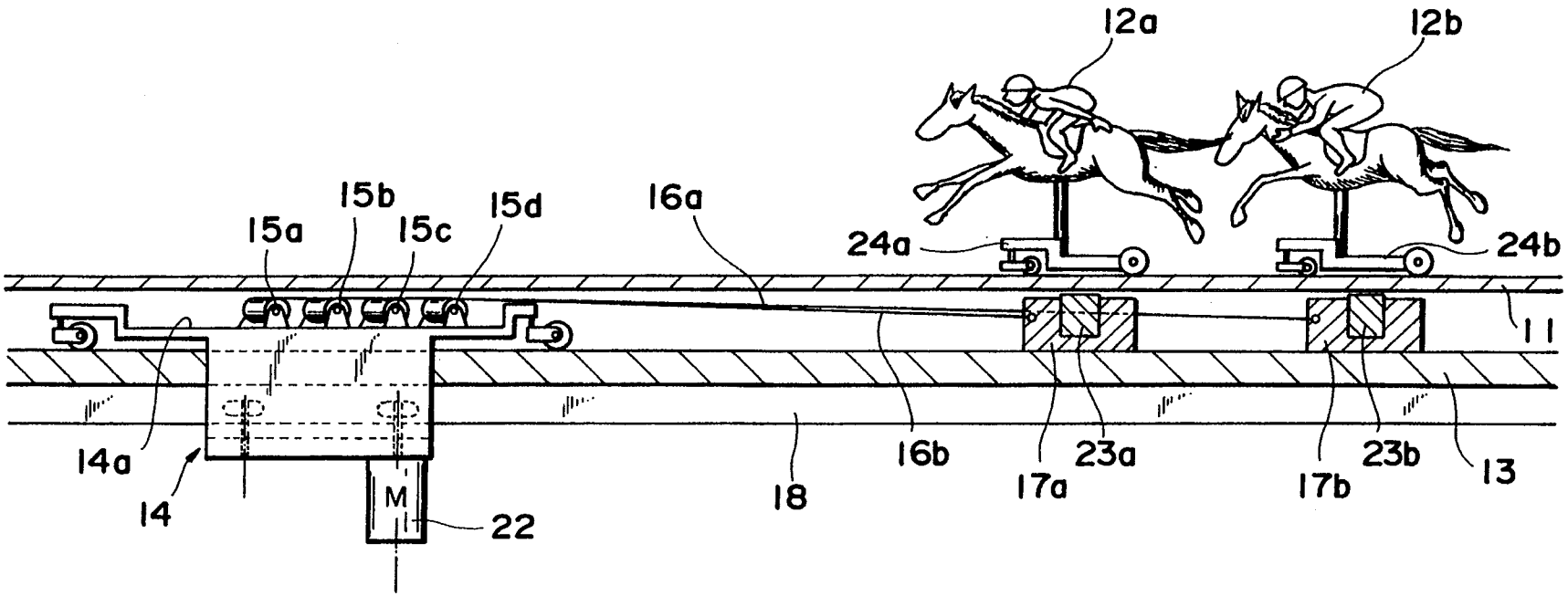
FIG. 4 is a sectional view of the racing game apparatus taken along the travel direction of the field course.

FIG. 4 is a sectional view (III—III′ sectional view of FIG. 1) of the racing game apparatus according to this embodiment taken along the travel direction of the field course drawn on the travel road surface plate 11. Referring to FIG. 4, the traction ropes 16*a*, 16*b*, . . . extend from the traction winches 15*a* to 15*d* provided to the upper surface plate 14*a* of the traction car 14, to tow the slidable shoes 17*a*, 17*b*, . . . arranged on the travel guide plate 13. Additionally, the shape of the slidable shoes may be ship-like shape in which tip end becomes narrower. In case that slidable shoes are formed of ship-like shape, it is much easier for slidable shoes to intrude into two slidable shoes which travel in contact each other.

The slidable shoes 17*a*, 17*b*, . . . move in accordance with the travel of the traction car 14. The moving speeds of the slidable shoes 17*a*, 17*b*, . . . can be changed by separately driving the traction winches 15*a* to 15*d*. More specifically, when the traction winch 15*a* is operated to take up the traction rope 16*a*, the slidable shoe 17*a* connected to the distal end of the traction rope 16*a* can be moved faster than the traction car 14. When the traction winch 15*a* is operated to rewind the traction rope 16*a*, the slidable shoe 17*a* connected to the distal end of the traction rope 16*a* can be moved slower than the traction car 14. When the slidable shoes 17*a*, 17*b*, . . . are moved at different speeds in this manner, the racing model bodies 12*a*, 12*b*, . . . attracted by the slidable shoes 17*a*, 17*b*, . . . travel at different speeds.

Since the slidable shoes 17*a*, 17*b*, . . . are towed by the flexible traction ropes 16*a*, 16*b*, . . . , they have freedom to move on the travel guide plate 13 in a direction perpendicular to the travel direction. Therefore, although the slidable shoes 17*a*, 17*b*, . . . move parallel to each other at the straight portions of the field course, at the curved portions, many slidable shoes 17*a*, 17*b*, . . . can gather at the innermost course and move. This is because the slidable shoes 17*a*, 17*b*, . . . move along a minimum distance. Accordingly, the racing model bodies 12*a*, 12*b*, . . . attracted by the slidable shoes 17*a*, 17*b*, . . . move in the same manner, so that they travel parallel to each other at the straight courses and travel in a row on the inner course at the corners, thus realizing a motion very close to that of an actual Derby race.

Figure 5:
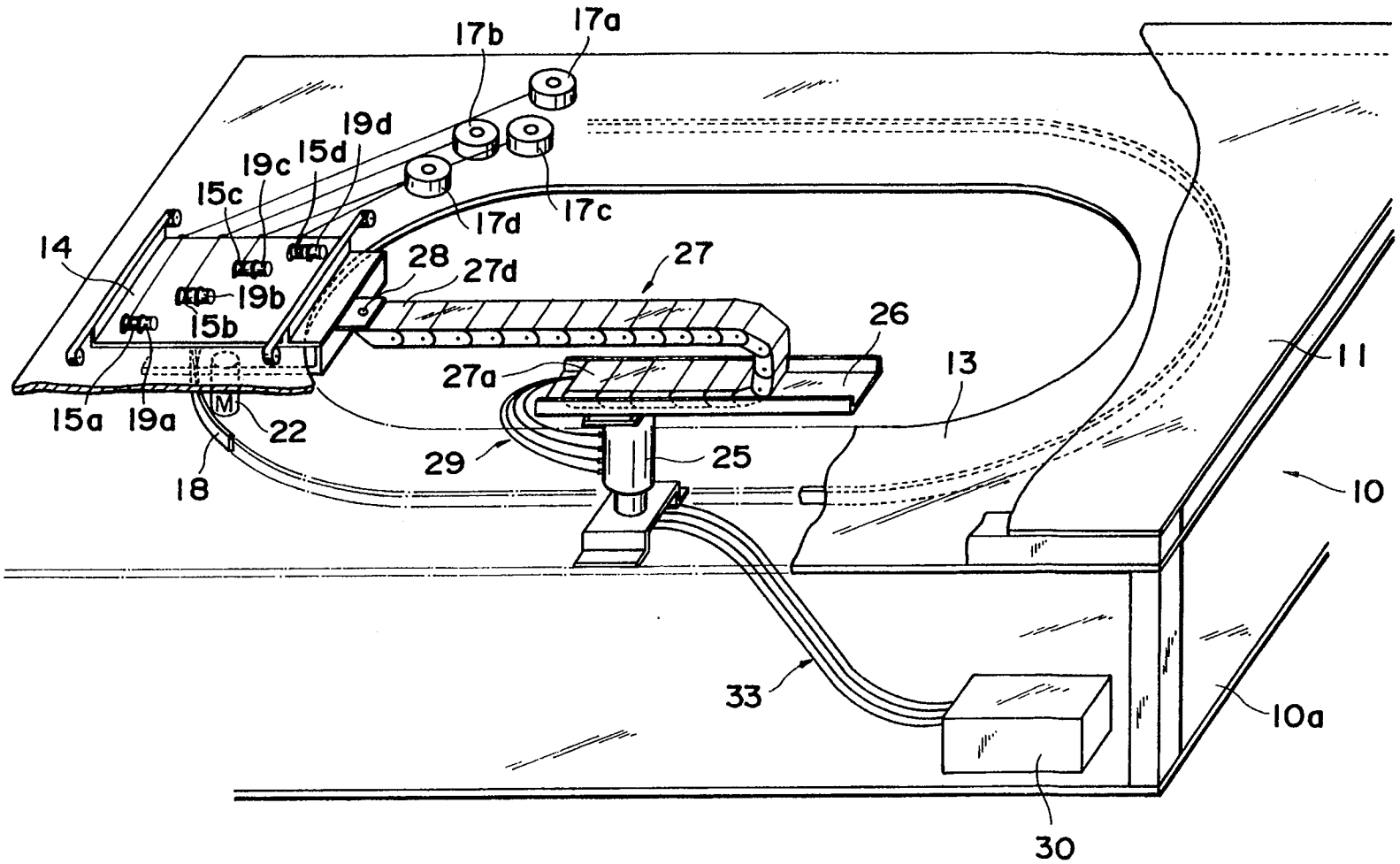
FIG. 5 is a perspective view showing the outer appearance of a racing game apparatus according to an embodiment of the present invention.

FIG. 5 is a perspective view showing a power supply mechanism for supplying power to the traction car 14. Referring to FIG. 5, a rotary power supply unit 25 is placed at the center of a bottom surface 10*a* of the cabinet 10, and an arm guide support groove plate 26 is mounted on the rotary power supply unit 25. A hollow cable supporter, that is, cable-built-in arm 27 which is bent into a "U" shape is placed on the arm guide support groove plate 26, and a proximal end portion 27*a* of the cable supporter 27 is fixed on the arm guide support groove plate 26. The traction car 14 is fixed to a distal end portion 17*b* of the cable supporter 27 with a coupling pin 28.

Figure 6:
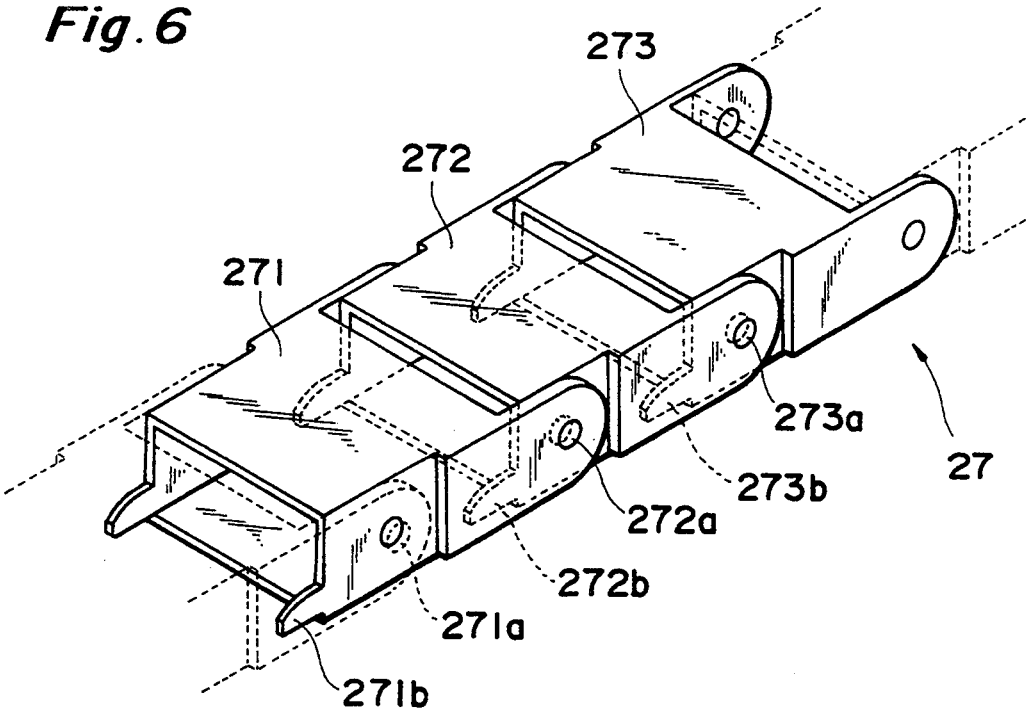
FIG. 6 is a perspective view showing the structure of cable supporter.
Figure 7:
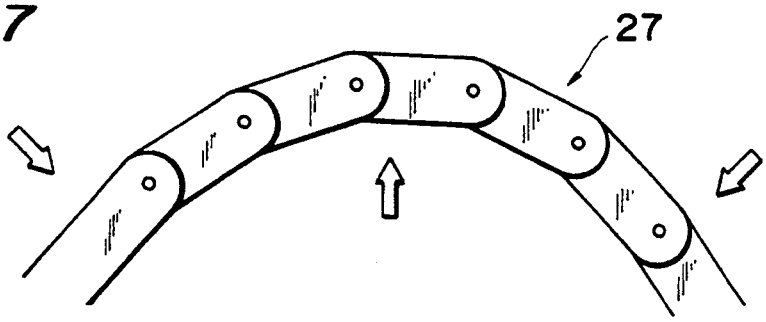
FIG. 7 is a plan view showing the structure of cable supporter.
Figure 8:
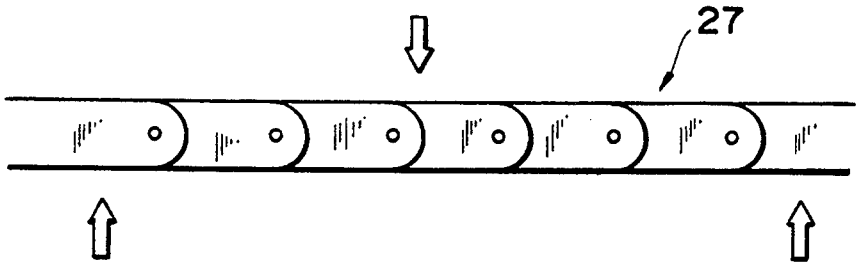
FIG. 8 is a plan view showing the structure of cable supporter.

As shown in FIGS. 6, 7 and 8, the cable supporter 27 has a chain structure in which a plurality of offset links (metal pieces) 271 to 273 are connected to each other with coupling pins 271*a* to 273*a*. The offset links 271 to 273 are provided with projections 271*b* to 273*b* for interfering rotation in one direction, so that the cable supporter 27 can be bent only in one direction, as shown in FIGS. 7 and 8. Cable hoses supporting guide apparatus made by TSUBAKIMOTO CHAIN such as TKP0320-1B,2B may be used as the supporter cable.

Thus, the cable supporter 27 provided on the rotary power supply unit 25 shown in FIG. 1 can flex only in a direction (vertical direction) along a plane including the rotary shaft of the rotary power supply unit 25. Since the cable supporter 27 can be bent only in one direction in this manner, a portion of the cable supporter 27 above the bent portion becomes linear. Since the cable supporter 27 is not bent in a direction (horizontal direction) along a plane perpendicular to the rotary shaft of the rotary power supply unit 25, it follows the circulating operation of the traction car 14 in a straight state. Thus, the rotary power supply unit 25 rotates in an interlocked manner with this circulating operation.

Since the traction car 14 travels along the elliptic track, the distance between the traction car 14 and the rotary power supply unit 25 changes as the traction car 14 travels. Since the cable supporter 27 has the structure described above, it can cope with a change in distance between the traction car 14 and the rotary power supply unit 25 by shifting the bent position of the cable supporter 27. In this case, since the cable supporter 27 can smoothly deform with substantially no load, no energy loss is caused.

The cable supporter 27 covers cables 29 that transmit power, supplied from a power supply unit 30 to the rotary power supply unit 25, to the traction car 14. By this transmission, power is supplied to drive motors 19*a* to 19*d* of the traction winches 15*a* to 15*d* of the traction car 14 and to a travel guide motor 22. Even if the distance between the traction car 14 and the rotary power supply unit 25 changes, the length of the cable supporter 27 does not change, so that the cables 29 covered with the cable supporter 27 will not loosen.

The cable supporter 27 itself is a technique already realized in the field of industrial robots and is utilized in, e.g., an extendible arm portion. This embodiment is an application of this technique. An example of application of a cable supporter in the field of industrial robots includes model MELFA RC-321 of Mitsubishi Electric Co., Ltd.

Figure 9:
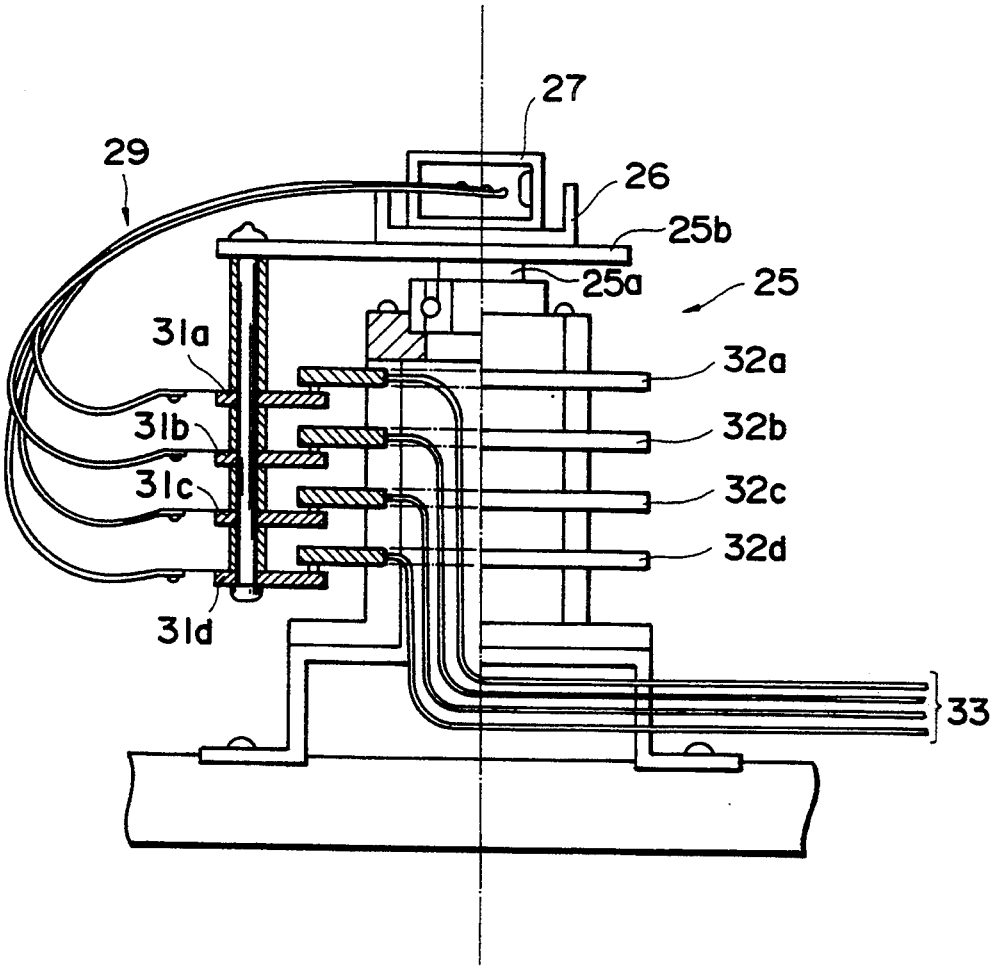
FIG. 9 is a sectional view showing the structure of a rotary power supply unit.

FIG. 9 is cross sectional view showing an example of a rotary supply unit which can be used for the embodiment of the invention. The rotary power supply unit 25 has a structure as shown in the sectional view of FIG. 9. An upper surface plate 25*b* is provided to the upper portion of a rotary shaft 25*a*. The cable supporter guide support groove plate 26 is mounted on the upper surface plate 25*b*, and the cable supporter 27 is fixed on the cable supporter guide support groove plate 26. Slidable conductive brushes 31*a* to 31*d* are mounted to one end of the upper surface plate 25*b* and connected to the cables 29 for supplying power to the traction car 14. The slidable conductive brushes 31*a* to 31*d* are always in contact with rings, for example, disk-like induction pole plates 32*a* to 32*d*, and power cables 33 extending from the rings 32*a* to 32*d* are connected to the power supply unit 30. Thus, when the cable supporter 27 is rotated as the traction car 14 travels, the slidable conductive brushes 31*a* to 31*d* move along the peripheries of the rings 32*a* to 32*d* while they are constantly in contact with the rings 32*a* to 32*d*. Therefore, power from the power supply unit 30 is constantly supplied to the traction car 14. Slip rings "SPK-100-9P-02" made by HIKARI DENSHI KOGYO can be used for the rotary power supply unit of the embodiment.

Figure 10:
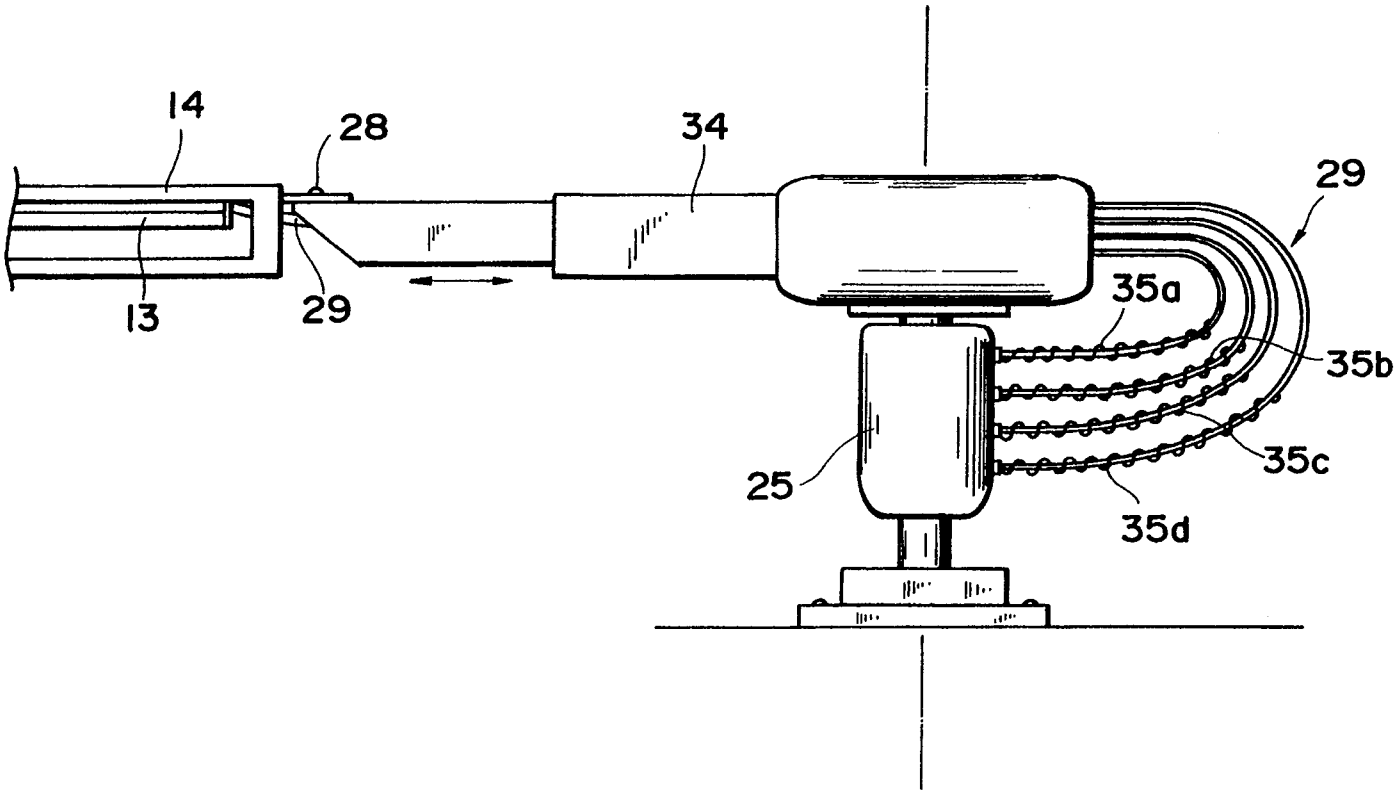
FIG. 10 is a side view showing a power supply mechanism for supplying power to the traction car.

FIG. 10 shows a modification of the power supply mechanism shown in FIG. 5. In this modification, a cable supporter such as cable-built-in arm 34 having an extendible telescopic structure is used in place of the cable supporter 27 having the chain structure. Spring members 35*a* to 35*d* are wound on cables 29 extending from the cable supporter 34 so that the cables will not loosen even if the cable supporter 34 is contracted.

Although the guide rail 18 is used in this embodiment to guide the traction car 14, a chain may be used in place of the rail. In this case, a chain is extended (at a position close to the center or the outer side) to replace the guide rail 18, and the traction car 14 is towed by the chain. When the chain is used, control of the current position and position detection of the traction car 14 are facilitated.

The racing game apparatus according to the present invention is not limited to a Derby race but can similarly be applied to a car race, a boat race, and the like.

Furthermore, the number of racing model bodies 12*a* to 12*d* towed by the traction car 14 is not limited to four but may be, e.g., eight.

Also, in this embodiment, the racing model bodies 12*a* to 12*d* are towed by the traction car 14. However, the present invention is not limited to the scheme of causing the racing model bodies 12*a* to 12*d* to travel by traction, but can employ the scheme of directly attracting racing model bodies 12*a* to 12*d* on the car and causing them to travel, as shown in the conventional case of FIG. 10.

Power supplied to the rotary power supply unit 25 is not limited to that from the power supply unit 30 incorporated in this apparatus but can be power supplied from an external power supply unit.

According to the racing game apparatus of the present invention, since the traction car and the carriers are towed through the flexible pulling members, the respective carriers can freely move in a direction perpendicular to the travel direction. Thus, although the mobile models travel parallel to each other on the respective courses at straight portions of the travel road, at curved (corner) portions (and the straight portions before the curved portions when the pulling members are sufficiently long) of the travel road, the mobile models traveling on outer courses shift to the inner course, so that many mobile models travel on the inner course.

In this manner, with the racing game apparatus according to the present invention, people can enjoy an exciting race in which respective mobile models compete in disorder and which is comparable to an actual Derby race.

According to the racing game apparatus of the present invention, the cable supporter flexes along a plane including the rotary shaft of the rotary base. Therefore, even if the distance between the travel car and the rotary base changes upon travel along the elliptic track, the cable supporter can follow the travel car with a smooth rotary movement. Therefore, power for travel is constantly supplied to the travel car through the power supply cables extending through the cable supporter.

Since the power supply cables extend through the interior of the cable supporter, they will not be entangled with each other even if the distance between the rotary base and the travel car changes.

In this manner, according to the racing game apparatus of the present invention, a plurality of mobile models can be caused to travel with a very simple mechanism. Thus, a racing game apparatus free from troubles can be provided at a low price.

What is claimed is:

1. A racing game apparatus in which a plurality of mobile bodies compete on a predetermined travel road surface plate, the racing game comprising:

a travel car arranged to travel along a travel road surface plate;

a plurality of mobile bodies arranged to travel across the travel road surface plate;

a plurality of carriers for attracting said mobile bodies to cause the mobile bodies to travel on the travel road by using magnetic force such that each carrier has an associated mobile body; and a plurality of flexible string members for connecting said travel car with said plurality of carriers such that each string member has an associated carrier.

2. A racing game apparatus according to claim 1, further comprising a guide portion provided under said travel road surface plate, wherein said travel car travels along said guide portion.

3. A racing game apparatus according to claim 2, further comprising a plurality of winch units, each winch unit being carried by the travel car and attached to an associated string member, each winch unit being operative for unwinding and rewinding said string members.

4. A racing game apparatus according to claim 3, wherein said plurality of winch units are independently operable so that the plurality of mobile bodies may travel at different speeds.

5. A racing game apparatus according to claim 3, further comprising guiding members provided at a rear end of said travel car for guiding said string members.

6. A racing game apparatus according to claim 4, further comprising guiding members provided at a rear end of said travel car for guiding said string members.

7. A racing game apparatus according to claim 2, wherein each said carrier and associated mobile body further comprise a means to obtain an attraction force between said carrier and associated mobile body through the travel road surface plate.

8. A racing game apparatus according to claim 3, wherein said plurality of winch units are equidistantly provided on said travel car in a direction perpendicular to a direction of travel of said travel car.

9. A racing game apparatus according to claim 2, further comprising a travelling mechanism attached to the travel car, the travelling mechanism including:

a guide roller in contact with a first side of the guide portion;

a drive roller in contact with a second side of the guide portion; and a means for rotating said drive roller whereby the travel car is propelled along the guide portion.

10. A travel car according to claim 1, further comprising:

a rotary power supply unit arranged inside of said travel road surface plate, said power supply unit having a rotary shaft perpendicular to a plane parallel to said travel road surface plate, a cable supporter, having one end fixed to said rotary shaft and the other end fixed to said travel car, said cable supporter being flexible only along the plane parallel to said rotary shaft, and power supply cables, covered with said cable supporter, for transmitting power from said rotary power supply unit to said travel car.

11. A racing game apparatus according to claim 10, wherein said rotary power supply unit has slidable brushes connected with power supply cables from said cable supporter, said supply unit having fixed rings which are always in contact with said slidable brushes.

12. A racing game apparatus according to claim 10, wherein said cable supporter has a chain structure in which a plurality of offset links are connected to each other with coupling pins.

13. A racing game apparatus according to claim 11, wherein said cable supporter has a chain structure in which a plurality of offset links are connected to each other with coupling pins.

* * * * *